US005987822A

United States Patent [19]

McNiff et al.

[11] Patent Number: 5,987,822

[45] Date of Patent: Nov. 23, 1999

[54] INFLATABLE TENT

[75] Inventors: Eric J. McNiff, Gloucester; Christopher G. Rowen, Rockport, both of Mass.; Paul Calabro, Eastchester, N.Y.

[73] Assignee: Cyrk, Inc., Gloucester, Mass.

[21] Appl. No.: 08/932,667

[22] Filed: Sep. 18, 1997

[51] Int. Cl.[6] ..... E04B 1/34

[52] U.S. Cl. ..... 52/2.11; 52/2.13; 52/2.18; 135/125

[58] Field of Search ..... 52/2.11, 2.13, 52/2.18, 2.22, 2.24; 135/119, 125

[56] References Cited

U.S. PATENT DOCUMENTS

| | | | |
|---|---|---|---|
| 547,119 | 10/1895 | Heaton et al. . | |
| 2,819,724 | 1/1958 | Barker . | |
| 2,875,771 | 3/1959 | Brewin | 52/2.11 |
| 3,899,853 | 8/1975 | Wertman . | |
| 4,000,749 | 1/1977 | Busco . | |
| 4,093,302 | 6/1978 | Adams | 296/23 |
| 4,197,681 | 4/1980 | Holcombe . | |
| 4,384,435 | 5/1983 | Polise et al. . | |
| 4,556,391 | 12/1985 | Tardivel et al. . | |
| 4,631,873 | 12/1986 | Parish . | |
| 4,766,918 | 8/1988 | Odekirk . | |
| 4,876,829 | 10/1989 | Mattick . | |
| 4,932,169 | 6/1990 | Charbonneau . | |
| 4,959,901 | 10/1990 | Parish . | |
| 4,977,633 | 12/1990 | Chaffee . | |
| 5,007,212 | 4/1991 | Fritts et al. . | |
| 5,205,086 | 4/1993 | Heim . | |
| 5,247,768 | 9/1993 | Russo . | |
| 5,267,363 | 12/1993 | Chaffee . | |
| 5,367,726 | 11/1994 | Chaffee . | |
| 5,487,400 | 1/1996 | Dawkins . | |
| 5,502,927 | 4/1996 | Hammerton . | |
| 5,555,679 | 9/1996 | Scherbac . | |
| 5,570,544 | 11/1996 | Hale et al. . | |
| 5,615,521 | 4/1997 | Simerka . | |
| 5,630,296 | 5/1997 | Kendall, Jr. . | |
| 5,761,852 | 6/1998 | Liu | 52/2.18 |

*Primary Examiner*—Carl D. Friedman
*Assistant Examiner*—Timothy B. Kangv
*Attorney, Agent, or Firm*—Christie, Parker & Hale, LLP

[57] ABSTRACT

An inflatable tent comprises a frame and an optionally removable cover. The frame has a single inflatable continuous generally-tubular member. The generally-tubular member comprises a base section and an upright section. The base section is fixedly attached at one or more connection points to the upright section. The upright section comprises a rounded main arch having two ends, both of which are fixedly attached to the base section. The upright section further comprises at least one rounded supporting arch segment having one end attached to the main arch and the other end attached to the base section.

9 Claims, 3 Drawing Sheets

INFLATABLE TENT

FIELD OF THE INVENTION

The present invention relates to an inflatable tent, and more particularly to an inflatable tent having a continuous tubular frame.

BACKGROUND OF THE INVENTION

Inflatable tents have been designed in the past. Some have inflatable walls and floors, resulting in a rather heavy tent that takes considerable time to inflate. Others have inflatable frames to support the tent walls and floor. It is this latter type of inflatable tent to which the present invention is directed.

An important function of an inflatable tent is that it be quick and easy to erect and collapse. It is also important that an inflatable tent be lightweight and easy to store and carry. With these goals in mind, it is also important that the inflatable tent have structural integrity. Additionally, because it is almost inevitable that an inflatable tent frame will ultimately puncture or be damaged to the point where it can no longer be used, it is important to provide a means by which the tent cover can still be used, such as with poles. Finally, a tent should be easy and inexpensive to manufacture, thus keeping the cost down for the consumer. The present invention is directed to an inflatable tent designed to achieve each of these goals.

SUMMARY OF THE INVENTION

One aspect of the present invention is a tent comprising a frame and a removable cover. The frame consists essentially of a single inflatable continuous generally-tubular member, which comprises a base section and an upright section. The base section is fixedly attached at one or more connection points to the upright section. The removable cover has an inside and an outside and is capable of enclosing the frame and capable of having its inside temporarily attached to the frame.

Another aspect of the invention is a tent comprising a frame and a cover capable of enclosing the frame. The frame comprises a single inflatable continuous generally-tubular member comprising a base section and an upright section. The upright section comprises a rounded main arch having two ends, both ends being fixedly attached to the base section, and at least one rounded supporting arch segment having two ends, wherein one end is fixedly attached to the main arch and the other end is fixedly attached to the base section.

DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION OF THE INVENTION

Figure 1:
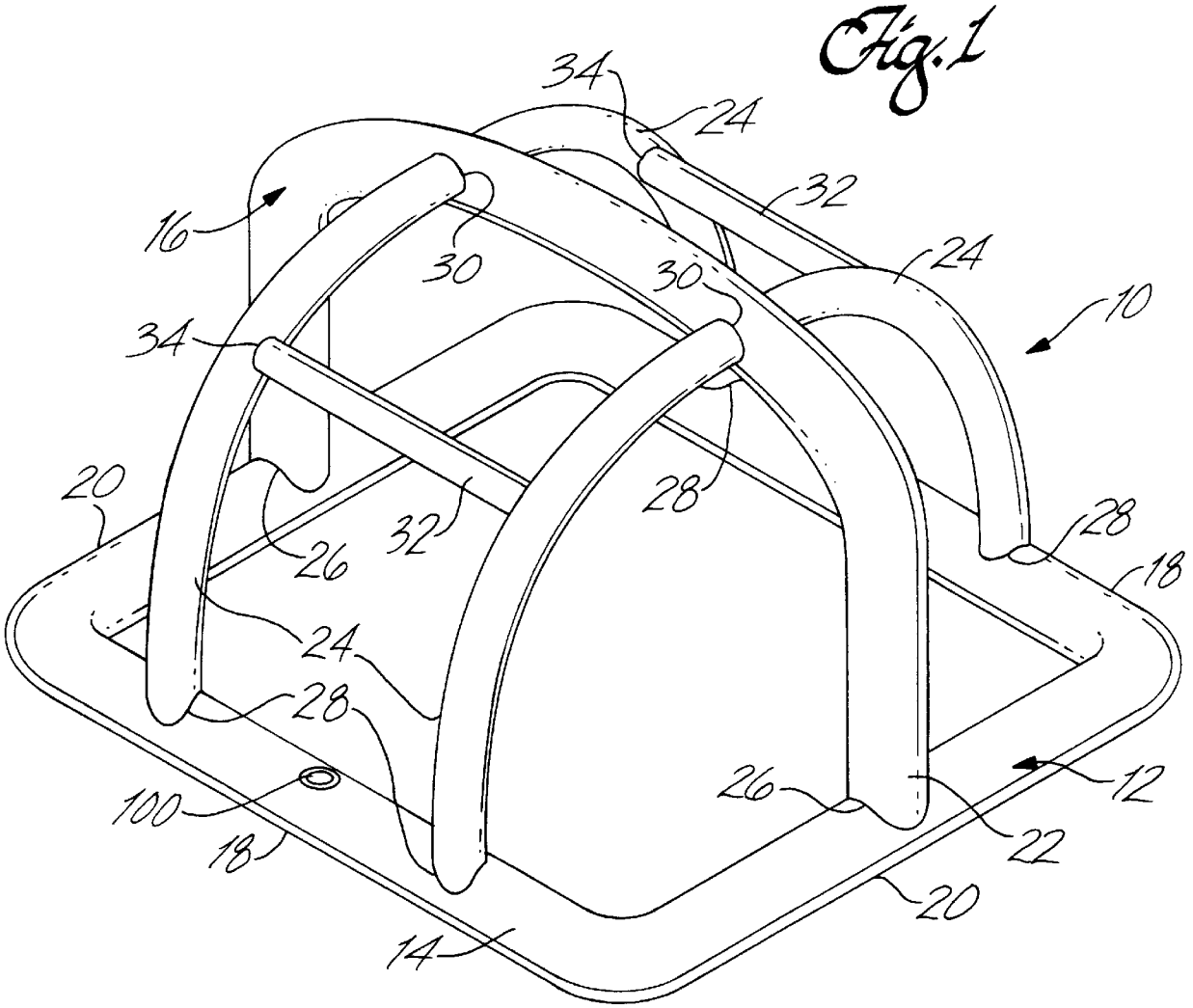
FIG. 1 illustrates an inflatable tent frame according to the present invention.

The present invention is directed to an inflatable tent comprising a frame and a cover. FIGS. 1, 2, 3*a* and 3*b* provide a preferred embodiment of an inflatable tent according to the present invention. With reference to FIG. 1, the frame 10 comprises a single inflatable continuous generally-tubular member 12, which creates the shape of the tent and is used to support the cover. The cross-sectional area of the generally-tubular member 12 can be, for example, a circle, an oval or a rectangle with rounded corners, and is preferably a circle.

The continuous tubular member 12 allows for injection of a fluid, preferably air, at a single location to inflate the entire tubular member by passage of the fluid throughout the entire member. When inflated, the tubular member 12 is rigid enough to support the cover without substantial sagging by the tubular member or the cover.

The tubular member 12 comprises a base section 14, which provides a foundation for the tent, and an upright section 16, which gives shape to the tent. The base section 14 and upright section 16 are fixedly attached at one or more locations.

The base section 14 is preferably rectangular in shape, but can also have other shapes, such as circular, oval, square and other polygonal shapes. When the tubular member 12 is rectangular in shape it comprises two parallel lengthwise edges 18, which are the longer sides of the rectangular base, and two parallel widthwise edges 20, which are the shorter sides of the rectangular base.

The base section 14 can be of any reasonable size. It is preferred, however, that the base section be no bigger than that required to sleep three persons. Preferably the lengthwise edges 18 range in length from about 75 to 110 inches, and more preferably from about 85 to 95 inches. The widthwise edges 20 preferably range in length from about 65 to 100 inches, and more preferably from about 80 to 90 inches.

It is also preferred that the base section 14 be of such a size to allow placement of an air mattress inside the base section. Preferably, when the air mattress is inflated it fills the entire area within the base section 14 such that all of the sides of the air mattress are snug against the inside edges of the base section, and such that the air mattress is, in effect, the floor of the tent. Suitable air mattresses are described in U.S. Pat. Nos. 4,977,633, 5,267,363, and 5,367,726, the disclosures of which are incorporated herein by reference. A preferred air mattress is the Aero TRAILBED.

Fixedly attached to the base section 14 at multiple locations is the upright section 16. In one embodiment, the upright section 16 comprises a main arch 22 and one or more supporting arch segments 24. The main arch 22 and supporting arch segments 24 each have two ends. The main arch 22 and supporting arch segments 24 are preferably rounded, i.e., have no angled-corners. One example of a rounded main arch 22 is shown in FIG. 1, where the main arch has straight sides meeting a rounded top.

Alternatively, the main arch 22 and/or the supporting arch segments 24 can comprise two or more straight segments connected at an angle rather than the rounded design. This angled design is less desirable, however, because it provides less support than the rounded design and is more difficult and expensive to manufacture than the rounded design.

When the base section 14 is rectangular, the main arch 22 is situated parallel to the lengthwise edges 18 and is fixedly attached at both of its ends, preferably at an angle of about 90 degrees, to each of the widthwise edges 20 at connection points 26. Connection points 26 are preferably located at or near the midpoints of the widthwise edges 20. When the base section 14 is circular, the main arch 22 preferably spans the diameter of the circular base section and is fixedly attached at both of its ends to the circular base at connection points 26 located at opposite sides of the circular base. When the base section is a shape other than rectangular or circular, the main arch 22 preferably spans the longest distance across the base section and is fixedly attached at both of its ends at opposite sides of the base section.

When the base section 14 is rectangular, each supporting arch segment 24 is parallel to the widthwise edges 20. One end of each supporting arch segment 24 is fixedly attached, preferably at an angle of about 90 degrees, to one of the lengthwise edges 18 at a connection point 28 and the other end of each supporting arch segment 24 is fixedly attached to the main arch 24 at a connection point 30. Preferably the supporting arch segments 24 are fixedly attached to the main arch 22 at an angle ranging from about 85 to about 95 degrees, more preferably ranging from about 87 to about 93 degrees, and still more preferably at an angle of about 90 degrees.

Figure 2:
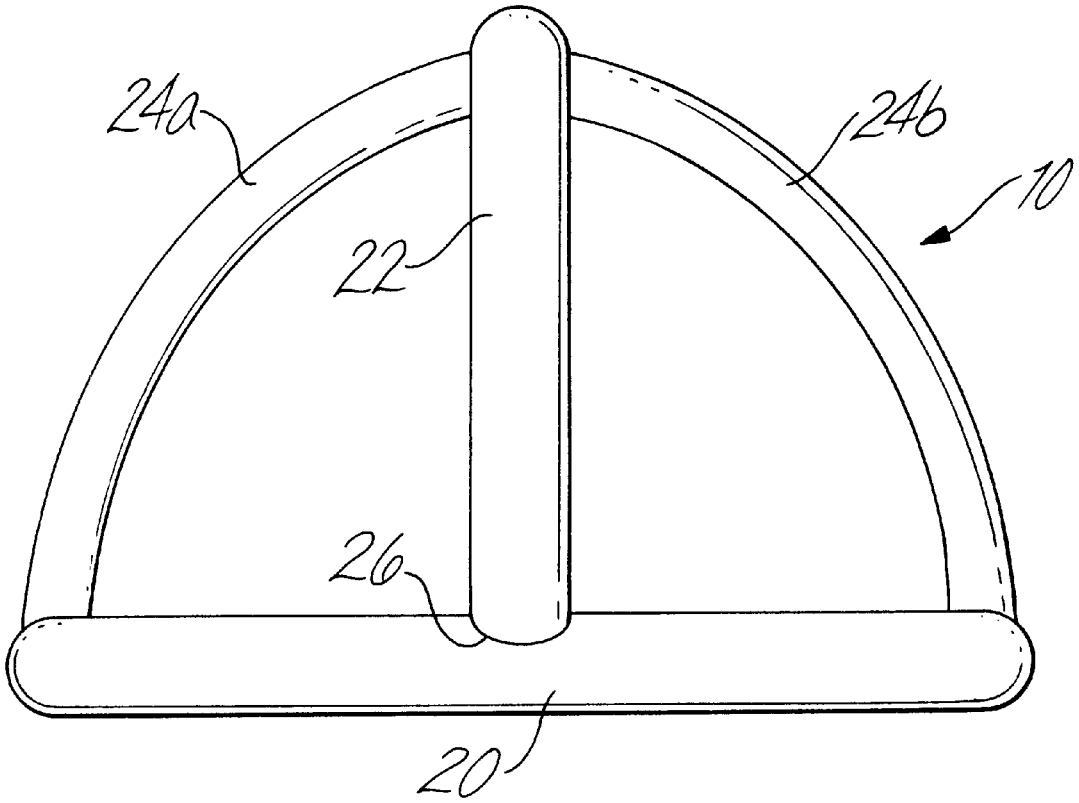
FIG. 2 is a side view of the inflatable tent frame of FIG. 1.

As illustrated in FIG. 2, the upright section preferably comprises supporting arches 24 in pairs, such that each left side supporting arch segment 24*a* has a mirror image right side supporting arch segment 24*b*. The left side supporting arch segment 24*a* and the right side supporting arch segment 24*b* are connected to opposite sides of the main arch 22 at connection points 30 and are connected to opposite lengthwise edges 18 at connection points 28 such that, but for the presence of the main arch 22, the pair of supporting arch segments would form a single arch parallel to the widthwise edges 20. In a preferred embodiment, the upright section 16 comprises two pairs of supporting arch segments 24.

Preferably the upright section further comprises one or more cross beams 32 having two ends. Each cross beam 32 is fixedly attached to two supporting arch segments 24, such that the two ends of each cross beam 32 are fixedly attached to two different supporting arch segments 24 at connection points 34. The cross beams 32 are preferably parallel to the lengthwise edges 20 and connect, preferably at an angle of about 90 degrees, to the supporting arch segments 24. The cross beams 32 provide additional support and greater rigidity to the upright section 16. In a preferred embodiment, the upright section 16 comprises two cross beams 32, each connecting one of the two pairs of supporting arch segments 24.

Other alternative designs for the upright section 16 are possible and are considered to be within the scope of the present invention. For example, the upright section 16 could comprise a plurality of main arches 22, where supporting arch segments 24 may or may not be necessary and cross beams 32 can be used to connect the main arches 22. Alternatively, the upright section 16 could comprise two main arches 22, each spanning diagonally across the base section 14 from opposite corners, thus forming an "X" shape. In another alternative embodiment, cross beams 32 can be used where one end is connected to a supporting arch segment 24 and the other end is connected to the main arch 22.

The main arch 22, supporting arch segments 24, cross beams 32, and base section 14 can be fixedly attached to one another by any suitable means. Preferably they are heat-welded, but can also be sewn, for example. Preferably each section of the frame 10, i.e., the main arch 22, each supporting arch segment 24, each cross beam 32, and the base section 14, has a consistent circumference from end to end, although each different segment need not have the same circumference as the other segments. Alternatively, a segment can taper from one end to the other. For example, the main arch 22 can taper from bottom to top, such that it is more lightweight at the top.

In a preferred embodiment, all of the connection points 26, 28, 30 and 34 contain air passage openings. In an alternative embodiment, connection points 30, connecting the supporting arch segments 24 to the main arch 22, do not contain air passage openings. Other combinations of connection points that contain air passage openings and connection points that do not contain air passage openings can exist, so long as the entire tubular member 12 can be inflated by injection of a fluid at a single location, as described above.

The air passage openings should be large enough to permit the fluid to move quickly from one section into another. Preferably the air passage openings for the main arch 22, supporting arch segments 24, and cross beams 32 are as large as the inner diameters of the main arch, supporting arch segments, and cross beams respectively.

A cover capable of enclosing the frame 10 is also provided. The cover comprises a single flexible fabric that forms an enclosed region in which the frame 10 can be located and that has an inside and an outside. By single flexible fabric it is not meant that the cover cannot be made of more than one material, but rather only that the entire cover is a single continuous cover enclosing the entire frame 10. To erect the tent of the present invention, the frame 10 is situated within the enclosed region of the cover and inflated, thus giving shape to the cover.

The cover can be formed of any appropriate material. Preferably the material is durable, lightweight, tear-resistant, puncture-resistant, fire-retardant, and/or waterproof. In a preferred embodiment, the cover is formed of two different materials. The bottom portion of the cover, i.e., the portion that would contact the base section 14 of the tent and the ground on which the tent sits, is preferably formed of a durable waterproof plastic, such as polyethylene. The upper portion of the cover, i.e., the portion that would cover the upright section 16 of the tent, is preferably made of a durable, lightweight waterproof material such as nylon. More preferably, the nylon is flame-retardant. When these two different portions are used, they can be sewn or otherwise fixedly attached to each other, and preferably have polyvinylchloride piping at the seam. The portion of the cover that contacts the base section 14 is preferably of a size such that it covers the side edges of the base section 14.

The cover contains at least one opening for users to enter and exit the tent. The opening can be of any shape, and preferably is rectangular with rounded top corners. In a preferred embodiment, the opening can be closed by a flap fixedly attached to the cover. Preferably the flap is the same shape as the opening. Preferably the flap is fixedly attached to the cover at the flap's bottom edge, and preferably the flap's bottom edge attaches to the cover at the seam where the bottom and top portions of the cover meet.

When closed, the edges of the flap that are not fixedly attached to the cover can be temporarily attached to the cover by any suitable temporary closing means. One preferred closing means is a double-sided zipper, allowing the user to open and close the flap from both inside and outside the tent.

Additionally, the opening can also be covered with a screen, which allows air into the tent, but keeps insects out of the tent. The screen, which is preferably the same shape as the opening, can also be fixedly attached to the cover. The screen is preferably fixedly attached to the cover at the screen's bottom edge, and can similarly be opened and closed by any suitable temporary closing means, such as a double-sided zipper.

The cover can optionally contain one or more vents and/or windows. For example, the vents can be similar to the opening described above, having a screen with a double zipper and a flap with a double zipper. Alternatively the vents can comprise a non-removable and non-openable screen with a flap cover that can be propped open by tying the ends of the flap cover to the ground. Other types of vents and windows would be known to one skilled in the art and are all considered within the scope of the present invention. The vents and/or windows can be placed at any suitable location on the cover, such as on top, on the sides, or on the back opposite the opening.

In a preferred embodiment, the cover is a removable cover 50. The removable cover 50 is designed to be temporarily attached to the frame 10, but also to be easily removed from the frame. This design allows the user to use the removable cover 50 with traditional tent poles in the event that the inflatable frame 10 becomes damaged and unusable. The user simply unattaches the inside of the removable cover 50 from the frame 10, deflates the frame, and pulls the frame out the opening.

Figure 3A:
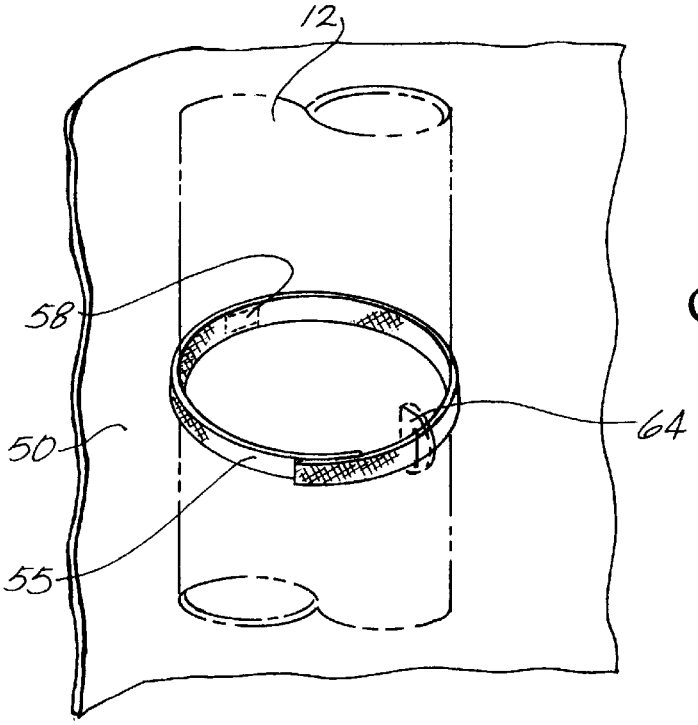
FIGS. 3*a* and 3*b* illustrate how the cover is attached to the inflatable frame.
Figure 3B:
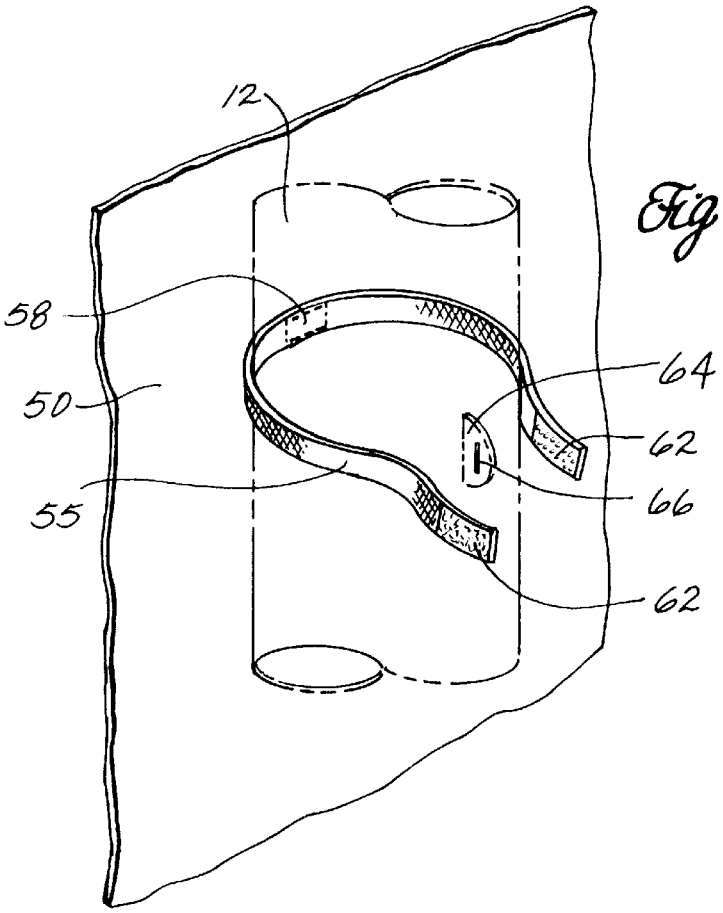

The removable cover 50 can be temporarily attached to the frame 10 in any manner that allows easy removal from the frame. In a preferred embodiment, as illustrated in FIGS. 3*a* and 3*b,* straps 55 having two ends are sewn or otherwise fixedly attached to the inside of the removable cover 50. Each strap 55 preferably comprises a single rectangular strip of fabric fixedly attached at or near its midpoint 58 to the inside of the removable cover 50. The two ends of each strap are provided with temporary attaching means 62 that can adhere to each other when repeatedly pressed together and opened. The preferred temporary attaching means 62 are VELCRO brand patches. Alternatively, the ends of the straps 55 can be tied together. The straps 55 can be wrapped around any portion of the tubular member 12, including the main arch 22, supporting arch segments 24, cross beams 32, and/or base section 14.

The straps 55 can be situated in any suitable manner. In a preferred embodiment, eleven straps 55 are attached to the inside cover so as to wrap around the four corners of the base section 14, around the top of the main arch 22, approximately halfway up the two sides of the main arch 22, and approximately halfway up each of the supporting arch segments 24.

To keep the straps 55 from sliding along the tubular member 12, resulting in an undesirable shifting of the removable cover 50 on the frame 10, tabs 64 can be located at various locations on the tubular member 12. The tabs 64 contain slits 66 through which the straps 55 can fit. The tabs 64 are provided at locations on the tubular member 12 corresponding to the locations of the straps 55 attached to the inside of the removable cover. Thus, when the removable cover 50 is correctly positioned on the frame, each strap 55, when wrapped around the tubular member 12, can be placed through a tab 64.

When the cover is not removable, it can be fixedly attached to the frame 10 by any suitable means. For example, the means described above for attaching the removable cover can be used, except the straps 55, instead of comprising temporary attaching means 62, are permanently closed around the tubular member 12. Other means for fixedly attaching the cover to the frame 10 would be known to those skilled in the art and are considered to be within the scope of the present invention.

In one embodiment, the tent further comprises a second frame, preferably located outside the cover, to provide backup support for the cover. The second frame can also be used instead of the inflatable frame if the inflatable frame should become damaged and unusable. The second frame comprises preferably one or more lightweight flexible poles capable of being temporarily attached to the cover.

The poles are preferably made of fiberglass, but can also be made of any lightweight flexible material such as graphite or titanium. In one embodiment, each pole is hollow and comprises multiple pole sections permanently joined by an elastic cord running through the hollow centers of the pole sections. Each pole section has a pole section connecting means at each end to temporarily connect the pole sections when in use. One preferred pole section connecting means is use of a male pole connector and/or a female pole connector at each end of each pole section for connection to the other pole sections. When not in use, the pole sections can be unconnected and the pole can be folded for convenient carrying and storage.

When in use, the pole sections are connected and the poles are preferably bended to form rounded arches. In one embodiment, three poles are used, a main arch pole and two supporting arch poles. The main arch pole is similar in shape to, but slightly larger than, the rounded main arch 22. The main arch pole is situated outside the cover, preferably directly above the main arch 22.

The supporting arch poles are preferably approximately semicircular in shape. The supporting arch poles are situated outside the cover and perpendicular to the main arch pole. Preferably the supporting arch poles are situated over the pairs of supporting arch segments 24. Depending on which poles are positioned first when the tent is erected, the tops of the supporting arch poles will be situated either directly under or directly over the main arch pole. Alternatively, the main arch pole can be used without the supporting arch poles, particularly when the second frame is being used as back-up support rather than in place of the inflatable frame.

In another alternative embodiment, two rounded poles of approximately equal size can be situated in an "X" formation, such that the ends of the poles are located near the corners of the base frame. Other configurations of poles can also be used and are considered to be within the scope of the present invention.

The pole sections located at the ends of the poles are connected to the base of the cover by a pole connecting means. A preferred pole connecting means comprises a female pole connector at each end of the pole and a male pole connector attached to the base of the cover. In one embodiment, each male pole connector is fixedly attached to a rigid ring, such as a metal or plastic ring. The ring is fixedly attached to a loop fixedly attached near the base of the cover. The loop can be made of any suitable flexible material, and is preferably the same material as the cover.

The outside of the cover contains one or more pole securing means for temporarily securing the poles to the cover. In a preferred embodiment, each pole securing means comprises one or more sleeves fixedly attached to the outside of the cover. The sleeves can be made of any suitable material, and preferably are the same material as the cover, which in a preferred embodiment is nylon. The sleeves are situated along the cover to correspond to the positions where the poles are to be placed and are designed to allow a pole to be slid through their center.

Each pole can be slid through a single continuous sleeve. Preferably, however, each pole securing means comprises multiple sleeves with spaces in between the sleeves to make it easier for the user to feed the pole through the sleeves. Preferably the sleeves are situated approximately a foot above the base of the cover on each side.

The tent preferably comprises a securing means for securing the tent to the ground. In a preferred embodiment, the securing means comprises one or more stake loops fixedly attached to the outside of the removable cover and positioned such that, when the frame is inflated, the stake loops are near the ground. The stake loops can be made of any suitable flexible material, and are preferably made of nylon webbing. A stake can then be driven into the ground through each stake loop to secure the tent to the ground. Any suitable stake can be used, as would be recognized to one skilled in the art.

Coupled to the tubular member 12 is a valve 100 though which the fluid can be introduced into the tubular member for inflation. Preferably the valve 100 is located at a position that is on the inside of the frame 10, i.e., on the side away from the cover 50, so that a user can reinflate a partially deflated frame without removing the cover. It is also preferred that the valve 100 is located on the base section 14, allowing the inflation mechanism, described below, to be situated on the ground and yet still near the valve during inflation. Particularly preferred valves are described in U.S. Pat. Nos. 4,977,633, 5,267,363, and 5,367,726. The frame 10 can then be inflated using any inflation mechanism. A preferred inflation mechanism is a pump, such as those described in U.S. Pat. Nos. 4,977,633, 5,267,363, and 5,367,726. A particularly preferred value and pump combination is that used with the Aero TRAILBED.

When the tent is deflated, it can be stored and carried in a carrying bag. Preferably the carrying bag is lightweight, but still large and strong enough to carry the tent as well as the poles and inflation mechanism. In one embodiment, the carrying bag is a tube-like bag, preferably having a mesh window to allow moisture out of the bag. The top can be covered with a flap. Preferably the carrying bag has a single strap and a cinch cord for easily closing the bag.

The above description of preferred embodiments of the inflatable tent of the present invention are for illustrative purposes. Because of variations that will be apparent to those skilled in the art, the present invention is not intended to be limited to the particular embodiments described above. The scope of the invention is defined in the following claims.

We claim:

1. A tent comprising:

a frame comprising a single inflatable continuous generally-tubular member, the generally-tubular member comprising:

a rectangular base section having two lengthwise edges and two widthwise edges shorter than the lengthwise edges; and an upright section comprising:

a rounded main arch having two ends and extending parallel to the lengthwise edges, wherein each of the two ends is connected to a different widthwise edge;

a first pair of supporting arch segments on one side of the main arch, each supporting arch segment extending from one lengthwise edge to the main arch;

a second pair of supporting arch segments on the other side of the main arch, each supporting arch segment extending from the other lengthwise edge to the main arch; and a cover having an inside and an outside, the cover enclosing the frame.

2. A tent according to claim 1, further comprising first and second cross beams, each cross beam having two ends, the two ends of the first cross beam being fixedly attached to the first pair of supporting arch segments, and the two ends of the second cross beam being fixedly attached to the second pair of supporting arch segments.

3. A tent according to claim 1, wherein the cover is a removable cover capable of being temporarily attached to the frame.

4. A tent according to claim 3, wherein the removable cover comprises a single flexible fabric.

5. A tent according to claim 1, wherein each supporting arch segment is fixedly attached to the main arch at an angle ranging from about 85 to about 95 degrees.

6. A tent according to claim 5, wherein each supporting arch segment is fixedly attached to the main arch at an angle ranging from about 87 to about 93 degrees.

7. A tent according to claim 7, wherein each supporting arch segment is fixedly attached to the main arch at an angle of about 90 degrees.

8. A tent according to claim 2, wherein the first cross beam is fixedly attached to each of the supporting arch segments of the first pair of supporting arch segments at an angle of about 90 degrees, and further wherein the second cross beam is fixedly attached to each of the supporting arch segments of the second pair of supporting arch segments at an angle of about 90 degrees.

9. A tent according to claim 1, wherein the main arch is connected to the widthwise edges at an angle of about 90 degrees.

* * * * *